United States Patent [19]

Pfeiffer

[11] Patent Number: 5,001,953

[45] Date of Patent: Mar. 26, 1991

[54] ELECTROMECHANICALLY OPERABLE APPARATUS FOR SEVERING STRIP

[75] Inventor: Horst Pfeiffer, Aldingen, Fed. Rep. of Germany

[73] Assignee: Hengstler GmbH, Tuttlinger, Fed. Rep. of Germany

[21] Appl. No.: 529,131

[22] Filed: May 25, 1990

[30] Foreign Application Priority Data

Jun. 8, 1989 [DE] Fed. Rep. of Germany ..... 3918662

[51] Int. Cl.[5] ..... B26D 5/14

[52] U.S. Cl. ..... 83/342; 83/349; 83/529; 83/602; 83/611

[58] Field of Search ..... 83/602, 604, 606, 672, 83/349, 342, 508, 628, 630, 527, 529, 530, 611, 612, 582, 583, 334, 335

[56] References Cited

U.S. PATENT DOCUMENTS

| | | | |
|---|---|---|---|
| 3,744,362 | 7/1973 | Gesell et al. | 83/602 X |
| 4,544,293 | 10/1985 | Cranston et al. | 83/602 X |
| 4,949,606 | 8/1990 | Pfeiffer | 83/349 X |

*Primary Examiner*—Hien H. Phan
*Assistant Examiner*—Kenneth E. Peterson
*Attorney, Agent, or Firm*—Dvorak and Traub

[57] ABSTRACT

This invention relates to an electromechanically operable apparatus for severing strip, such as a paper tape or plastic film tape, which is dispensed by a power-operated dispenser. A swingable cutter blade is connected to a crank, which is operated by a gear train via an eccentric drive and a connecting rod, which is provided with a cam track cooperating with the crank. In dependence on the condition of the cam track and the sense of rotation of a motor for driving the gear train the extent of the angular movement imparted to the swingable cutter blade can be selected for the making of a complete cut or a partial cut through the strip.

16 Claims, 3 Drawing Sheets

ELECTROMECHANICALLY OPERABLE APPARATUS FOR SEVERING STRIP

BACKGROUND OF THE INVENTION

1. Field of the Invention

This invention relates to an electromechanically operable apparatus for severing strip, such as paper tape or plastic film tape, which is dispensed by a power-operated dispenser, which apparatus comprises a helical swingable cutter and a stationary cutter for cooperating with the swingable cutter.

2. Description of the Prior Art

Such apparatuses for severing strip, which comprise a slightly helically distorted, swingable cutter blade and a stationary cutter blade, which is spring-urged against the swingable cutter blade, are known from German Utility Model No. 87 16 108. That known apparatus comprises an angle bar formed in one leg with an external recess for receiving the swingable cutter blade whereas the second leg constitutes a bottom member and a motor is accommodated in the angle between the two legs. The angle bar is adapted to be cut to a length corresponding to the width of the strip to be cut. That severing apparatus is intended to be attached to or installed in suitable equipment and is only adapted to make full cuts through the strip, such as printed strip, moving through the apparatus.

German Patent Specification No. 29 31 634 discloses a severing apparatus which can make also partial cuts. The apparatus comprises reciprocating cutter blades, which are actuated by means of rocker levers preceded by a gear segment. An electromagnet and a number of mechanically acting members are required for such actuation and involve a high expenditure.

SUMMARY OF THE INVENTION

It is an object of the invention to provide an electromechanically operable apparatus for severing strip, such as paper tape or plastic film tape, which is dispensed by a power-operable dispenser, which apparatus should permit a free selection of the mode of operation as regards a complete cut or a partial cut, as an alternative to perforating, to be effected in a simple manner by a suitable control of the drive motor without an alteration of the cutting means.

It is another object to provide such an apparatus which can easily be adjusted for cutting a strip in a desired width.

In an apparatus which is of the kind described first hereinbefore said objects are accomplished in accordance with the invention in that the apparatus comprises drive means which are operable to drive the swingable cutter and comprise a crank connected to the swingable cutter, an eccentric drive, a gear train for driving said eccentric drive, a connecting rod connecting said eccentric drive to said crank and provided with a cam track, which has a portion extending in the direction of the axis of the connecting rod and containing an adjusting screw, which is adjustable to control the operation of the crank and the range of the angular movement of the swingable cutter for making a complete or partial cut through the strip.

DETAILED DESCRIPTION OF THE PREFERRED EMBODIMENT

Figure 1:
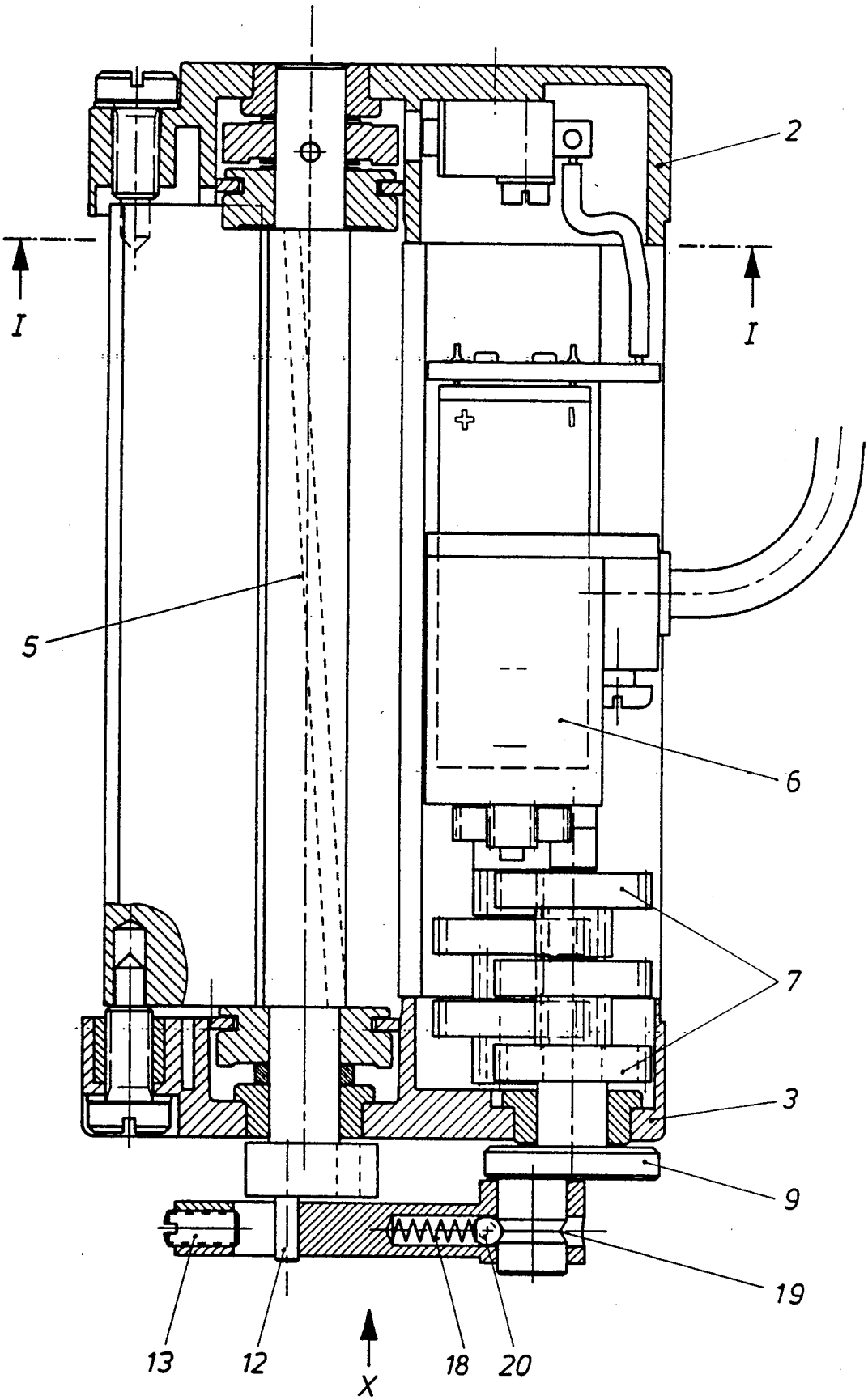
FIG. 1 is a top plan view showing a severing apparatus partly cut open.

Further features of the severing apparatus in accordance with the invention will become apparent from the following description of a preferred embodiment shown by way of example in the drawing.

The illustrated apparatus for severing strip consisting in the present case of a paper tape 1 comprises two end walls 2 and 3, between which a stationary cutter blade 4 and a slightly helically distorted swingable cutter blade 5 for cooperating with the stationary cutter blade 4 are disposed, which are mounted in said end walls 2 and 3. The stationary cutter blade 4 is preferably spring-urged against the swingable cutter blade 5. A drive motor 6, a gear train 7 driven by the motor 6, and a hood 8 covering the motor 6 and the gear train 7 are also disposed between the end walls 2 and 3. The swingable cutter blade 5 is driven via the gear train 7 and an eccentric drive 9 for driving a connecting rod 10, which is provided with a cam track 11, which cooperates with a crank 12 for driving the swingable cutter blade 5. The cam track 11 is generally L-shaped and has a first leg, which extends in the direction of the axis a—a of the connecting rod 10 and is adjustable by means of an adjusting screw 13. The second leg of the cam track 11 is generally at right angles to the first leg and has a slightly concavely curved forward edge and a slightly convexly curved rear edge 14.

Figure 2:
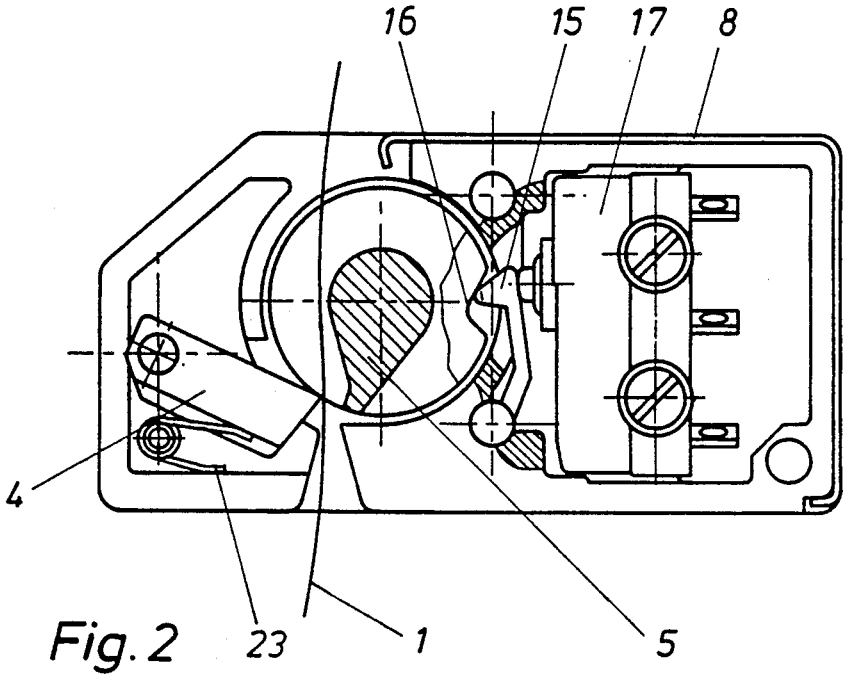
FIG. 2 is a transverse sectional view taken on line I—I in FIG. 1.

When the swingable cutter blade 5 is in its initial position shown in FIG. 2, a detent pawl 15 enters a notch 16 formed in the body of the cutter 5 to release the switch 17 for turning off the drive motor 6. When the gear train 7 drives the eccentric drive 9 in the sense indicated by the arrow A in FIGS. 3 and 4, i.e., in a counterclockwise sense, the crank 12 for driving the swingable cutter blade 5 will cooperate with the cam track 11 of the connecting rod 10 in the second leg thereof, which extends in the direction b—b, and will impart to the swingable cutter blade 5 an angular movement in the clockwise sense for making a complete cut through the paper tape 1.

The connecting rod 10 is pivoted to the eccentric drive 9 on a pin, which is formed with an annular groove 19. The connecting rod 10 contains a ball 20, which is urged into the groove 19 by a spring 18 so that a rotation of the eccentric drive 9 in the clockwise sense as viewed in FIGS. 3 and 5 will cause the connecting rod 10 to be raised so that the crank 12 for driving the swingable cutter blade 5 will cooperate with the cam track 11 in its first leg extending in the direction of the axis a—a of the connecting rod 10 and will impart to the swingable cutter blade 5 a smaller angular movement in the clockwise sense for making a partial cut through the paper tape 1. The making of a complete cut or of a partial cut will thus depend on the rotation of the eccentric drive 9 in the sense indicated by the arrow A or B, i.e., on the sense of rotation of the motor 6, which can properly be controlled. The extent of the angular movement of the swingable cutter blade 5 for making a partial cut can be adjusted by an adjustment of the adjusting screw 13 provided in the first leg of the cam track 11, which first leg extends in the direction of the axis a—a of the connecting rod 10.

Figure 3:
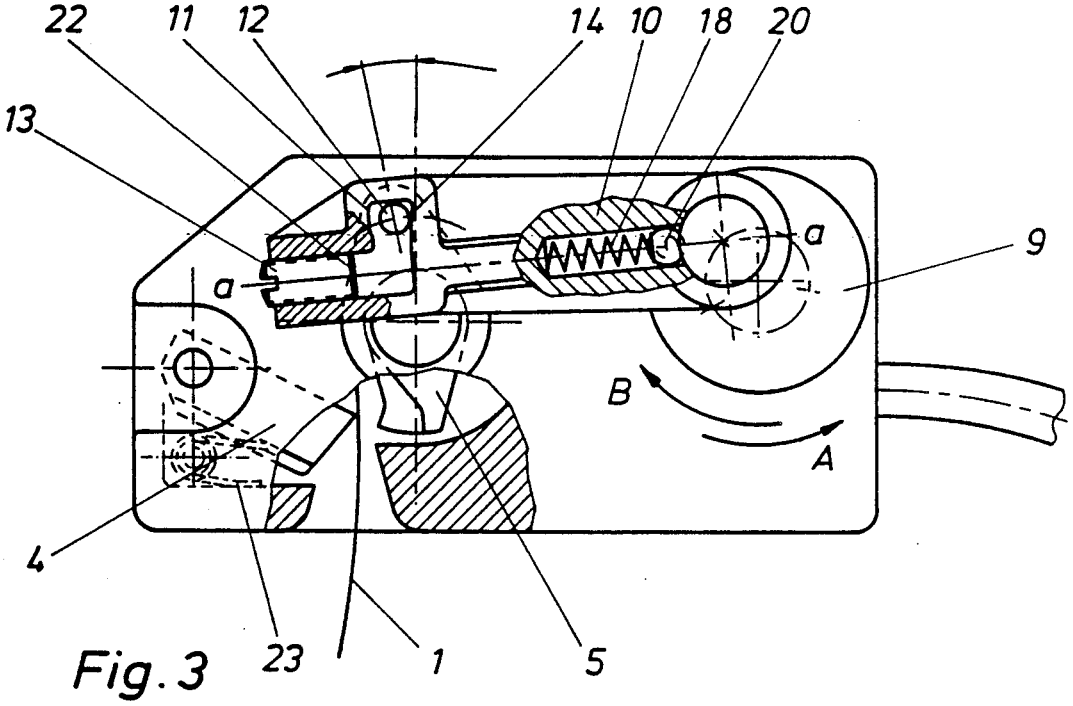
FIGS. 3 to 5 are elevations showing the apparatus, partly cut open, as viewed in the direction indicated by the arrow X in FIG. 1, in an initial position, in a position for making a complete cut and in a position for making a partial cut, respectively.
Figure 4:
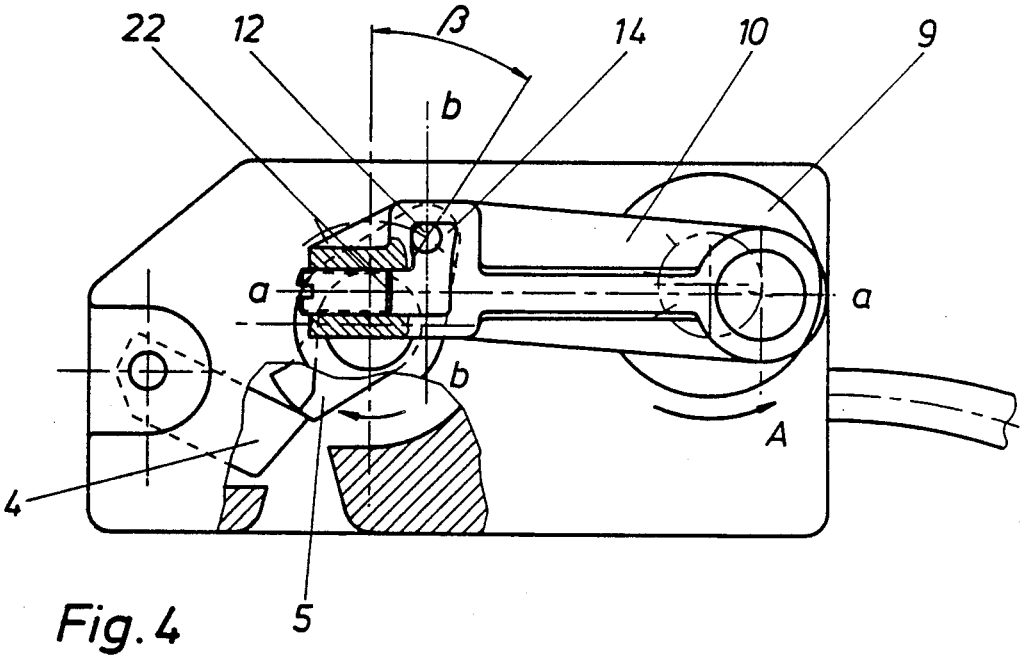

The severing apparatus is shown in FIGS. 2 and 3 in an initial position with the paper tape 1 threaded through the apparatus between the cutter blades 4 and 5. When a control pulse is delivered via the lead 21, which by-passes the switch 17, to the drive motor 6, the latter imparts via the gear train 7 to the eccentric drive a rotation in the sense indicated by the arrow A in FIG. 3. Before the eccentric drive 9 reaches its dead center, the distance between the knife edge of the swingable cutter blade 5 and the knife edge of the stationary cutter blade 4 will slightly be increased because the motor 6 has previously been de-energized. As the rotation of the eccentric drive 9 proceeds, the upper portion of the cam track 11 of the connecting rod 10 engages the crank 12 to impart to the swingable cutter blade 5 an angular movement in the clockwise sense until the position shown in FIG. 4 has been reached and the paper tape 1 has entirely been cut through.

As the rotation of the eccentric drive 9 is continued until the initial position has been reached, the swingable cutter blade 5 is also moved to its initial position. At that time the detent pawl 15 snaps into the recess 16 so that the switch 17 is actuated to turn off the motor 6. The severing apparatus is now again in its position of rest.

Figure 5:
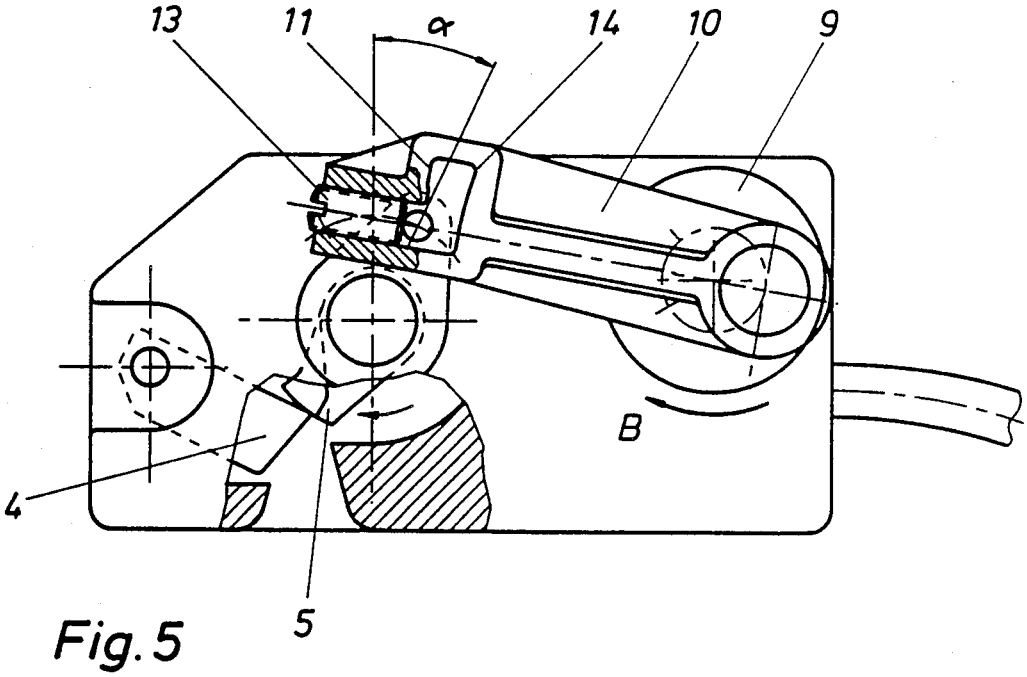

When the paper tape 1 which has been threaded through the apparatus is to be cut only in part of its width, the drive motor 6 is controlled to impart to the eccentric drive 9 a rotation in the sense indicated by the arrow B in FIGS. 3 and 5. Owing to the frictional coupling established between the connecting rod 10 and the eccentric drive 9 by the ball 20 that is biased by the spring 18, the connecting rod 10 is raised so that the crank 12 for driving the swingable cutter blade 5 engages the cam track 11 in its first leg, which is horizontal in FIG. 5. The swingable cutter blade 5 is again moved in the clockwise sense. Because the cam track 11 is now in a different position and the drive crank 12 strikes against the inner end face 22 of the adjusting screw 13 the swingable cutter blade 5 is now moved through an angle $\alpha$, which is smaller than the angle $\beta$ of the angular movement imparted to the swingable cutter blade 5 for making a complete cut and only a partial cut is now made through the paper tape 1. The width of the cut can be adjusted within a wide range by means of the adjusting screw 13. The adjusting screw 13 can be screwed into the first leg of the cam track 11 to such an extent that the inner end face of said screw is flush with the forward edge of the second leg of the cam track 11. In that case a complete cut can be made by a rotation of the motor 6 in either sense and the motor 6 will also be turned off in that the switch 17 is released by the detent pawl 15.

The stationary cutter blade 4 may serve also to guide the strip and is preferably urged against the swingable cutter blade 4 by a spring 13 for an automatic readjustment in order to compensate wear.

The stationary cutter 5 has a helical first knife edge. The stationary cutter 4 has a second knife edge for cooperating with said first knife edge. The crank 12 is connected to the swingable cutter 5 and cooperates with the cam track 11 for imparting to the swingable cutter 5 an angular cutting movement, in which said first knife edge cooperates with said second knife edge, and for providing between the crank 12 and the cam track 11 a lost motion generally in the direction of the axis a—a of the connecting rod 10. The adjusting screw 13 is longitudinally adjustably mounted in the first leg of the cam track 11 to adjust the extent of said lost motion and thus to control the extent of said angular cutting movement. The recess 16, the detent pawl 15 and the switch 17 constitute means for de-energizing the motor 6 when the eccentric drive 9 and the swingable cutter 5 are in a predetermined initial position, in which the first knife edge is clear of said second knife edge. The crank 12 is arranged to cooperate with the cam track 11 in said first leg upon a rotation of the eccentric drive 9 from said initial position in a first sense indicated by the arrow A and in said second leg upon a rotation of the eccentric drive 9 from said initial position in a second sense, which is opposite to said first sense and indicated by the arrow B. The eccentric drive 9 comprises a disk, which is adapted to be rotated by the motor 6 via the gear train 7, and a pin, which is eccentrically mounted on said disk. A first end portion of the connecting rod 10 is pivoted and frictionally coupled to said pin. Said pin is formed with an annular groove 19. The first end portion of the connecting rod 10 is formed with an axially extending bore, which is open to the groove 19 and contains a ball 20, which protrudes into the groove 19, and a compression spring 18, which urges the ball 20 into the groove 19 to establish a friction fit between said ball and groove.

I claim:

1. In an apparatus for severing strip, comprising a swingable cutter having a helical first knife edge;

a stationary cutter having a second knife edge for cooperating with said first knife edge to cut through a strip extending between said cutters; and electromechanical drive means for operating said swingable cutter;

the improvement residing in that said drive means comprise:

an electric motor;

an eccentric drive;

a gear train operatively connecting said eccentric drive to said motor;

a connecting rod having a longitudinal axis and connected to said eccentric drive and comprising a cam track extending generally in the direction of said axis;

a crank, which is connected to said swingable cutter and cooperates with said cam track for imparting to said swingable cutter an angular cutting movement, in which said first knife edge cooperates with said second knife edge, and for providing between said crank and said cam track a lost motion generally in the direction of said axis; and an adjusting screw, which is mounted in said cam track for adjustment along the longitudinal axis of said connecting rod to adjust the extent of said lost motion and thus to control the extent of said angular cutting movement.

2. The improvement set forth in claim 1, wherein said cam track comprises a first leg extending generally in the direction of said axis and a second leg, which is transverse to said axis;

said crank is adapted to cooperate with said cam track in said first and second legs to impart to said swingable cutter blade an angular cutting movement in which said first knife edge cooperates with said second knife edge; and said adjusting screw is longitudinally adjustably mounted in said first leg to adjust the extent of said lost motion and thus to control the extent of said angular cutting movement when said crank cooperates with said cam track in said first leg.

3. The improvement set forth in claim 2, wherein said crank is adapted to cooperate with said cam track in said second leg with a predetermined lost motion generally in the direction of said axis; and said adjusting screw is adjustable in said first leg to a position in which said screw is engageable with said crank to provide for said crank a lost motion which is generally in the direction of said axis and which is larger than said lost motion between said cam track in said second leg and said crank.

4. The improvement set forth in claim 2, wherein said eccentric drive is adapted to be driven by said electric motor via said gear train in a first sense and in a second sense, which is opposite to said first sense, and said crank is arranged to cooperate with said cam track in said first leg during a rotation of said eccentric drive in said first sense and to cooperate with said cam track in said second leg during a rotation of said eccentric drive in a second sense.

5. The improvement set forth in claim 4, wherein said electric motor is reversible for driving said eccentric drive in said first and second senses.

6. The improvement set forth in claim 2, wherein said connecting rod has a first end portion pivoted to said eccentric drive and a second end portion provided with said cam track, said cam track is generally L-shaped, and said second leg extends generally at right angles to said first leg.

7. The improvement set forth in claim 6, wherein said second leg flares in the direction in which it extends from said first leg.

8. The improvement set forth in claim 6, wherein means are provided for de-energizing said motor when said eccentric drive and said swingable cutter are in a predetermined initial position, in which said first knife edge is clear of said second knife edge; and said crank is arranged to cooperate with said cam track in said first leg upon a rotation of said eccentric drive from said initial position in a first sense and to cooperate with said cam track in said second leg upon a rotation of said eccentric drive from said initial position in a second sense, which is opposite to said first sense.

9. The improvement set forth in claim 8, wherein said eccentric drive comprises a disk, which is adapted to be rotated by said motor via said gear train, and a pin, which is eccentrically mounted on said disk; and said first end portion of said connecting rod is frictionally coupled to said pin.

10. The improvement set forth in claim 9, wherein said pin is formed with an annular groove; and said connecting rod is formed in said first end portion with an axially extending bore, which is open to said groove and contains a ball, which protrudes into said groove, and a compression spring, which urges said ball into said groove to establish a friction fit between said ball and groove.

11. The improvement set forth in claim 1, wherein said stationary cutter is arranged to guide said strip between said swingable cutter and said stationary cutter.

12. The improvement set forth in claim 11, wherein spring means are provided for urging said stationary cutter against said swingable cutter.

13. The improvement set forth in claim 11, wherein means are provided to readjust said stationary cutter relative to said stationary cutter for a compensation of wear of said stationary and swingable cutters.

14. The improvement set forth in claim 1, wherein said drive means are operable to move said swingable cutter to a predetermined initial position, said swingable cutter is formed with a recess, a switch is provided, which is adapted to turn off said electric motor, and a detent member is provided, which is arranged to enter said recess when said swingable cutter blade is in said initial position and to control said switch to deenergize said motor as said detent member enters said recess.

15. In an apparatus for severing strip, comprising a swingable cutter having a helical first knife edge;

a stationary cutter having a second knife edge for cooperating with said first knife edge to cut through a strip extending between said cutters; and electromechanical drive means for operating said swingable cutter;

the improvement residing in that said drive means comprise:

an electric motor;

an eccentric drive;

a gear train operatively connecting said eccentric drive to said motor;

a connecting rod having a longitudinal axis and connected to said eccentric drive;

a crank, which is connected to said swingable cutter;

a cam track, by which said connecting rod is operatively connected to said swingable cutter for imparting to said swingable cutter an angular cutting movement in which said first knife edge cooperates with said second knife edge; and an adjusting screw, which is mounted in said cam track for adjustment along the longitudinal axis of said connecting rod and controls the extent of said angular cutting movement.

16. The improvement set forth in claim 15, wherein means are provided for de-energizing said motor when said eccentric drive and said swingable cutter are in a predetermined initial position, in which said first knife edge is clear of said second knife edge; and said cam track comprises a first portion for operatively connecting said connecting rod to said swingable cutter for imparting to said swingable cutter said angular cutting movement to a first extent thereof and a second portion for operatively connecting said connecting rod to said swingable cutter for imparting to said swingable cutter said angular cutting movement to a second extent thereof, which differs from said first extent;

one of said first and second portions is defined by said adjusting screw; and said cam track is arranged to operatively connect said connecting rod to said crank in said first portion during a rotation of said eccentric drive from said initial position in a first sense, and in said second portion during a rotation of said eccentric drive from said initial position in a second sense, which is opposite to said first sense.

* * * * *